US005710411A

United States Patent [19]

Tippins et al.

[11] Patent Number: 5,710,411

[45] Date of Patent: Jan. 20, 1998

[54] INDUCTION HEATING IN A HOT REVERSING MILL FOR ISOTHERMALLY ROLLING STRIP PRODUCT

[75] Inventors: George W. Tippins; John E. Thomas, both of Pittsburgh, Pa.; Nicholas V. Ross, Youngstown, Ohio

[73] Assignees: Tippins Incorporated, Pittsburgh, Pa.; Ajax Magnethermic Corporation, Warren, Ohio

[21] Appl. No.: 521,961

[22] Filed: Aug. 31, 1995

[51] Int. Cl.[6] ..... H05B 6/02; B21B 37/74

[52] U.S. Cl. ..... 219/602; 219/632; 219/646; 148/567; 266/129; 72/202; 72/11.3; 72/201

[58] Field of Search ..... 219/602, 632, 219/635, 645, 646; 148/559, 567, 574; 266/129; 72/11.3, 8.5, 202, 200, 201

[56] References Cited

U.S. PATENT DOCUMENTS

| | | | |
|---|---|---|---|
| 3,587,268 | 6/1971 | Bricmont et al. | 219/602 |
| 3,610,315 | 10/1971 | Juergens et al. | 164/76 |
| 4,204,892 | 5/1980 | Economopoulos | 148/570 |
| 4,407,486 | 10/1983 | Mills et al. | 266/87 |
| 4,430,876 | 2/1984 | Ginzburg | 72/234 |
| 4,433,566 | 2/1984 | Tippins et al. | 72/229 |
| 4,491,006 | 1/1985 | Ginzburg et al. | 72/202 |
| 4,503,697 | 3/1985 | Tippins et al. | 72/202 |
| 4,522,050 | 6/1985 | Thomas | 72/229 |
| 4,555,922 | 12/1985 | Ginzburg | 72/229 |
| 4,627,259 | 12/1986 | Andersson et al. | 72/202 |
| 4,745,786 | 5/1988 | Wakako et al. | 148/504 |
| 4,751,360 | 6/1988 | Ross | 219/10.61 R |
| 5,133,205 | 7/1992 | Rostik et al. | 72/200 |
| 5,293,927 | 3/1994 | Anzai et al. | 164/484 |
| 5,296,050 | 3/1994 | Takamiya et al. | 148/111 |
| 5,461,770 | 10/1995 | Kimura et al. | 29/527.7 |

*Primary Examiner*—Philip H. Leung

*Attorney, Agent, or Firm*—Webb Ziesenheim Bruening Logsdon Orkin & Hanson, P.C.

[57] ABSTRACT

The present invention provides a hot reversing rolling mill for isothermally reducing a metal strip product. The mill includes a hot reversing mill stand with a pair of coilers positioned on opposite sides of the mill stand. At least one heater is positioned between one of the coilers and the mill stand with at least one strip cooling unit positioned between one of the coilers and the mill stand. A sensor is provided for sensing a strip parameter indicative of strip temperature as well as a controller for controlling each of the heating and cooling units in response to the sensed parameter. The rolling mill of the present invention can be utilized for isothermally rolling multiple passes of a metal strip product on the hot reversing mill.

9 Claims, 3 Drawing Sheets

INDUCTION HEATING IN A HOT REVERSING MILL FOR ISOTHERMALLY ROLLING STRIP PRODUCT

BACKGROUND OF THE INVENTION

1. Field of the Invention

The present invention relates to using induction heating to achieve isothermal temperature conditions during the rolling of steel slabs and the like into a strip or plate product through a hot reversing rolling mill.

2. Prior Art

It has been recognized for many years that strip shape is dependent on many factors, including the temperature at which hot rolling takes place. This dependence on temperature relates not only on the minimum temperatures needed for hot rolling to achieve the desired metallurgical properties, but also on any head to tail temperature differential which occurs and which then may change rolling conditions and result in shape problems. These temperature differentials are inherent in the rolling of the strip via a hot reversing mill because of the temperature decay which takes place over time and the difference in exposure time to ambient conditions at various positions along the product being rolled. Not only is there a temperature drop at the respective ends of the coil, but the extreme head and tail positions of the product realize greater heat decay because the lack of a heat reservoir ahead and to the rear of the head and tail positions, respectively. In addition, there tends to be a temperature buildup in the middle from frictional forces, and all of these conditions vary with the width of the strip as well.

In addition to strip shape, thickness tolerances must be maintained through such techniques as roll bending and automatic gauge control. These techniques may change rolling conditions and, thus, actual problem of temperature differentials.

A number of rolling methods and apparatus have been tried and are employed to correct these shape problems. Many such efforts are directed to correcting the shape should it be less than desired. Other solutions address the cause of the problem and attempt to reduce the head to tail temperature differential in the first place. These include tapered slabs, tapered rolling, coil boxes upstream of the rolling mill and zoom rolling wherein the speed of rolling is accelerated to create frictional heat energy to increase the temperature of the tail of the workpiece.

However, there remains a need for a method and apparatus which go to the root cause of the problem, namely, the change in temperature which takes place in a slab product being rolled to strip thickness on existing hot reversing mills.

Induction heaters for heating metal products are known as shown in U.S. Pat. No. 4,751,360 and 4,407,486. Additionally, the use of induction heaters for side edge heating of metal strip is shown in U.S. Pat. No. 4,627,259. Induction heating used in conjunction with continuous mills is known as shown in U.S. Pat. No. 5,133,205. This prior art does not address the issue of rolling on a hot reversing mill.

An object of this invention is to achieve isothermal rolling temperatures throughout any given pass through a reversing mill stand or stands through use of induction heating. By isothermal rolling temperature, it is meant as reasonably constant as possible so as to have a negligible effect on resultant shape.

It is also an object of this invention to achieve these isothermal rolling temperatures by also cooling the strip being rolled, as needed, in advance of the roll bite.

It is also an object of this invention to monitor temperature or temperature-dependent functions such as roll force so as to provide control loops for achieving the isothermal rolling conditions.

SUMMARY OF THE INVENTION

The objects of the present invention are carried out in a hot rolling process on a rolling mill including at least one hot reversing stand having coiler units on opposite sides thereof. The product is converted to strip by passing the product back and forth through the stand in successive passes to reduce the thickness of the work product and coiling the product during the rolling process when it reaches a coilable thickness. The improvement of the present invention comprises providing an induction heating unit between at least one of the coiler units and the hot reversing stand together with sensing mill loads on the hot reversing stand and monitoring the sensed loads to compare them with predetermined load differentials. These loads are a function of the rolling temperature. The induction heater is utilized to heat portions of the product, as needed, in response to the sensed loads to maintain constant hot rolling temperature throughout the product being rolled. The present invention may additionally provide a cooling unit, such as a laminar flow cooling spray, for cooling various portions of the work strip. The induction heating unit of the present invention is preferably expandable to adjust to the appropriate size of the strip being worked upon. Isothermal rolling conditions are met by either heating or cooling portions of the strip as the case may be.

These and other advantages of the present invention will be clarified in the description of the preferred embodiment taken together with the attached figures.

DESCRIPTION OF THE PREFERRED EMBODIMENT

Figure 1:
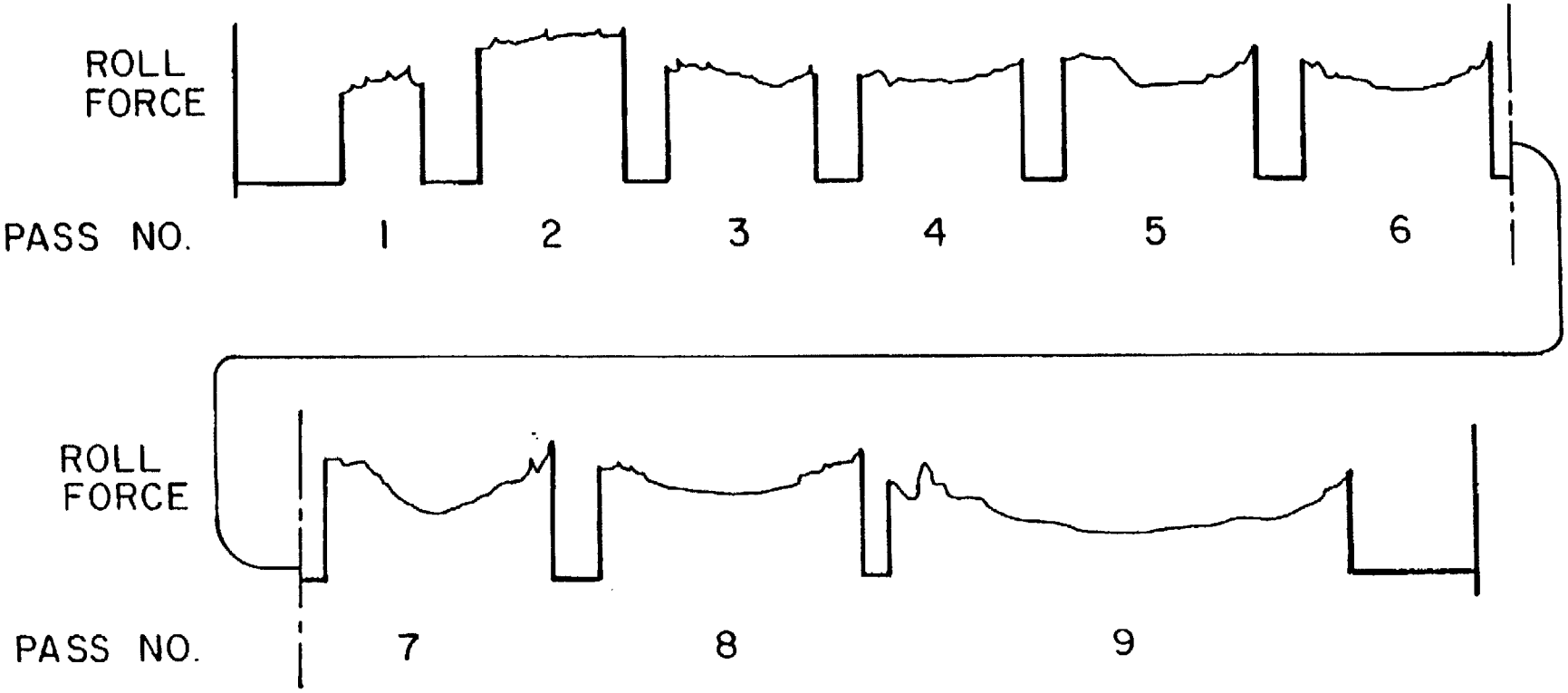
FIG. 1 PRIOR ART
FIG. 1 illustrates a chart of the separating forces which are required during conventional rolling of nine passes through a single stand hot reversing mill.
Figure 2:
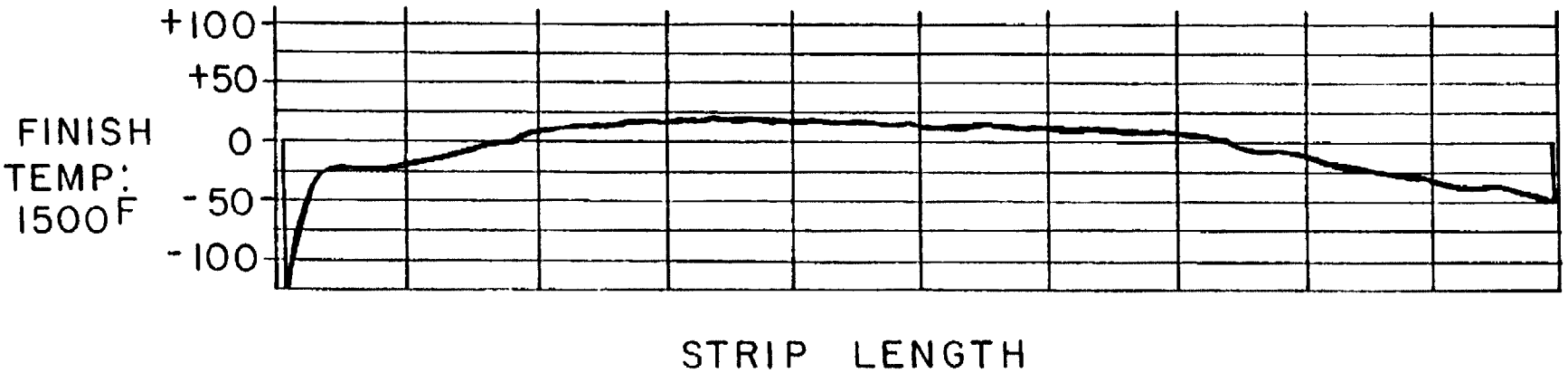
FIG. 2 PRIOR ART
FIG. 2 is a temperature profile of the last pass illustrated in FIG. 1.

Rolling with automatic gauge control of the front and tail ends of the workpiece can produce a sheet product with extremely small variation in strip thicknesses; however, the rolling function does induce internal stresses into the front and tail portion of the strip. These stresses are not apparent during the hot rolling process. However, after the workpiece cools and it is cut into pieces for fabrications, it is likely that the sheet will deform as the internal stresses are released which, of course, makes the ends of the workpiece unfit for use. FIG. 1 is a representation of separating forces for each of nine passes through a single stand hot reversing mill according to conventional rolling procedures. The magnitude of the separating force over any pass is directly related to the resistance of deformation of the material being worked. The resistance of deformation, in turn, is inversely related to the temperature of the workpiece. FIG. 2 illustrates the temperature profile of the last pass, pass nine, through the single stand rolling mill illustrated in FIG. 1. FIGS. 1 and 2 clearly demonstrate the inverse relationship between the separating force and the temperature of the workpiece. Consequently, a measurement of the separating force will provide a substantially accurate measurement of the temperature of the workpiece.

Due to the nature of hot reversing mills of the prior art, the front and back ends of the workpiece are inherently colder than the center portion. This characteristic is best illustrated in FIG. 2 where the temperature of the ends of the workpiece is shown substantially lower than that of the center. Although not specifically illustrated, a chart of the temperature for each of the previous eight passes would show similar decays in the temperature of the ends to a somewhat lesser degree. Referring to FIG. 1 illustrating the separating forces, which are inversely proportioned to the temperature of the workpiece, it can be seen that as early as pass three the end pieces of the workpiece are exhibiting a loss of rolling temperature (i.e., an increase in the separating force measured). As demonstrated in subsequent passes, this characteristic is increased with each subsequent pass. Further, an attempt to add heat to the strip prior to the last pass of the workpiece does not cure the problem since the workpiece has been deformed and worked and certain stresses may have been added and not necessarily dissipated in each of the previous passes.

As described herein, the present invention will monitor the rolling forces and, consequently, temperature and take corrective action to automatically add heat energy to the ends of the workpiece and cool the center of the workpiece as required for each pass so that as the workpiece rolls into the roll bite of the rolling mill, the mill will roll the workpiece in an isothermal condition throughout its length. The rolling of the workpiece under isothermal conditions helps increase the metallurgical properties of the resulting product, and decrease the end spread and non-uniform gauge presented and most importantly prevents the growth of internal stresses in the workpiece.

Both the head to tail temperature differential and the absolute rolling temperatures must be controlled to achieve optimum properties. By responding to early drifts in temperatures, it is possible to correct both the absolute temperature and any differential in the workpiece on a pass-by-pass basis. This temperature can be simulated on a screen as an inverse function of mill load and automatically controlled.

Figure 3:
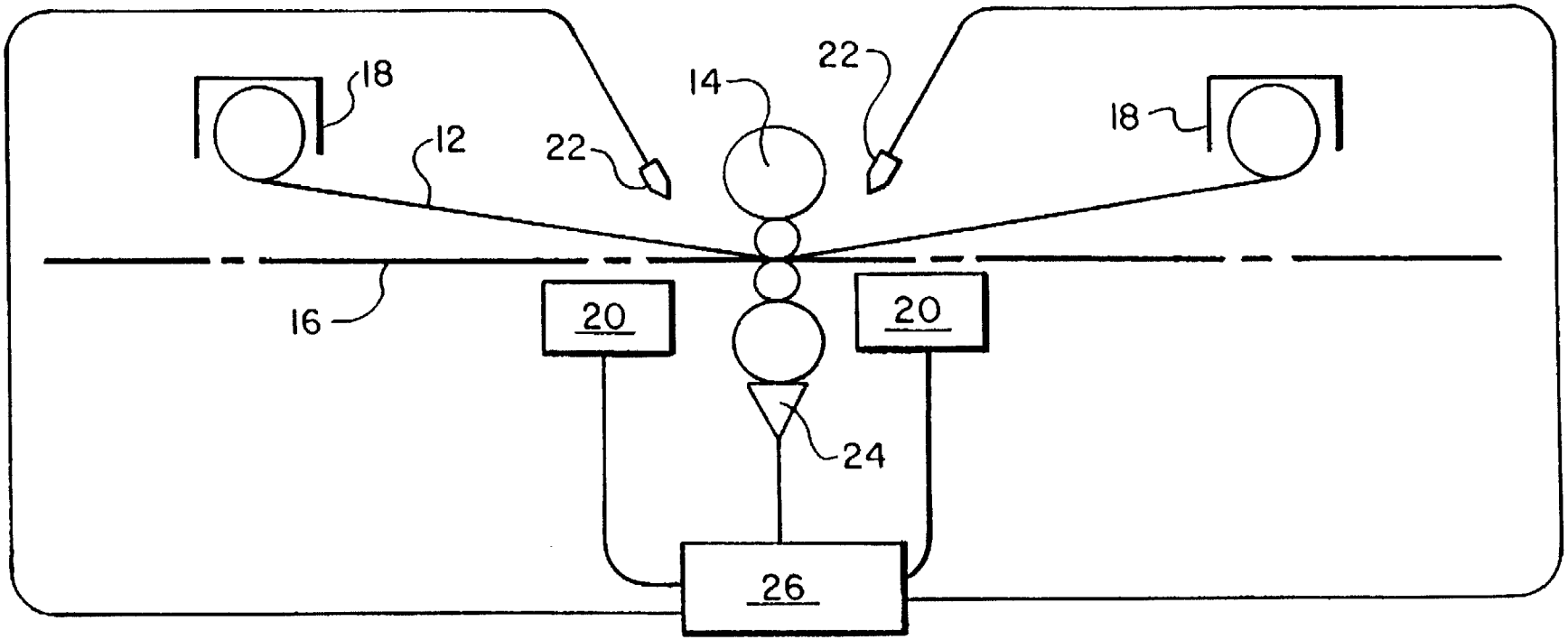
FIG. 3 schematically illustrates a reversing rolling mill according to the present invention.

FIG. 3 illustrates a hot rolling mill 10 for isothermally reducing a metal strip product 12 according to the present invention. The mill 10 includes a four-high reversing hot mill stand 14 positioned on the pass line 16 for the strip product 12. A pair of coiler furnaces 18 is positioned on opposite sides of the mill stand 14. It will be understood that a two stand mill may likewise be used in such an arrangement.

An induction heating unit 20 is positioned between each coiler furnace 18 and the mill stand 14. The induction heating unit 20 is formed of two side-by-side portions adjustable relative to each other to provide a width adjustment. The induction heating unit 20 is operable to quickly add a significant amount of heat energy to the strip product. Two independent high frequency power units 20 with heating coils should be applied to both sides of the rolling mill stand 14 for the most flexible operation which would include heating the strip before it enters the roll bite and also before it leaves the roll bite. However, for economy of capital cost, the inducting heating coils (that actually heat the workpiece) can be powered from one power unit which would shift energy alternatively to the induction coils for heating the strip before it enters the roll bite only.

A cooling spray 22 is additionally positioned between each coiler furnace 18 and the mill stand 14. The cooling spray 22 should preferably be actuated by a quick- acting valve. The cooling spray 22 may be water or other conventional cooling fluid for use in cooling metal strip products.

A force sensor 24 is attached to the rolling mill stand 14 for sensing the load or separating force thereon. The force sensor 24 is coupled to a controller 26 which controls the operation of each heating unit 20 and cooling spray 22. The sensor 24 may measure temperature, horsepower or other similar parameters.

In operation, the force sensor 24 measures the separating force on the work product during the pass. This sensed parameter is indicative of the temperature of the workpiece as described above. Additionally, the difference between the sensed parameter and a predetermined value is determined by the controller 26. The cooling spray 22 or heating unit 20 is activated by the controller 26, as appropriate, to modify the temperature condition of this portion of the strip.

The induction heating units, which are adjustable for product width, are generally operated over a short length of the strip, often as short as 5–25 feet at either the head and/or the tail of a coil. On the other hand, the laminar flow cooling is generally used to cool down the middle of the coil which has received a heat buildup from the frictional rolling forces.

The system according to the present invention provides a feedback control loop which allows the process to be a self-learning adaptive process as the workpiece is rolled. By rolling according to the present method, the wide variations in separating force and, consequently, temperature illustrated in FIG. 1 can be eliminated or reduced. This isothermal rolling will result in improved metallurgical properties as well as gauge and other associated parameters throughout the final product.

The heating units 20 may be positioned below the pass line 16 between rolls of the roller table. The cooling sprays 22 may be positioned above the pass line 16 to allow for gravity assist for the cooling sprays.

It should be apparent to those of ordinary skill in the art that various modifications may be made to the present invention without departing from the spirit and scope thereof. Consequently, the scope of the present invention is intended to be defined by the attached claims.

What is claimed is:

1. A method of isothermally rolling in multiple passes a metal strip product on a hot reversing mill comprising:

a) repeatedly passing a metal strip product at a hot rolling temperature through a reversing rolling mill, wherein an induction heater for heating said metal strip product is positioned in proximity to said reversing rolling mill and a cooling unit for cooling said metal strip product is positioned in proximity to said reversing rolling mill;

b) sensing one of a temperature condition or a temperature-dependent condition at spaced positions on said metal strip product being rolled during each said pass; and c) selectively induction heating or cooling portions of said metal strip product with said induction heater or said cooling unit in response to predetermined differentials between said sensed conditions to achieve isothermal rolling conditions at said hot rolling temperatures.

2. The method of claim 1 wherein said sensing includes monitoring mill loads at the rolling mill and using said monitored mill loads as the temperature-dependent condition for controlling said induction heating and said cooling.

3. The method of claim 1 including coiling said product on coilers positioned on opposite sides of said at least one hot reversing mill when said product is reduced in thickness to a coilable thickness.

4. The method of claim 3 wherein said induction heating occurs at a location between at least one of said coilers and said hot reversing mill.

5. The method of claim 4 wherein said induction heater positioned below a pass line.

6. In a hot rolling process carried out on a hot rolling mill including at least one hot reversing stand having coiler units on opposite sides thereof, whereby product is converted to strip by passing said product back and forth through said stand in successive passes to reduce the thickness and coiling said product when it reaches a coilable thickness, the improvement comprising providing an induction heating unit between at least one of said coiler units and said hot reversing stand, sensing mill loads on the hot reversing stand, monitoring said sensed loads and comparing them to predetermined load differentials which are a function of rolling temperature and induction heating portions of said product in response to a predetermined condition of said comparison to maintain constant hot rolling temperatures throughout said product being rolled.

7. In a processing line including a hot rolling mill for converting slab product to strip, the improvement comprising a sensing unit for monitoring one of a slab product temperature condition and a rolling condition which is a function of temperature, a control unit for comparing said monitored conditions to a standard and at least one induction heating means and at least one cooling means located along the processing line approximate to the rolling mill and responsive to said control unit wherein rolling temperatures are maintained constant throughout any given pass through the rolling mill, wherein said rolling mill includes at least one hot reversing stand having coilers on opposite sides thereof and an induction heating unit positioned between at least one of said coilers and said hot reversing mill.

8. The processing line of claim 7 wherein said induction heating unit is positioned below a pass line of said mill processing line.

9. The processing line of claim 8 wherein said induction heating unit is adjustable to accommodate varying widths of product being rolled.

* * * * *